US010502214B2

(12) United States Patent
Mikkelsen et al.

(10) Patent No.: US 10,502,214 B2
(45) **Date of Patent: *Dec. 10, 2019**

(54) CENTRIFUGAL PUMP

(71) Applicant: GRUNDFOS HOLDING A/S, Bjerringbro (DK)

(72) Inventors: Steen Mikkelsen, Bjerringbro (DK); Brian Lundsted Poulsen, Langå (DK); Jens Andersen Gad, København Ø (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 296 days.

This patent is subject to a terminal disclaimer.

(21) Appl. No.: 14/895,270

(22) PCT Filed: May 15, 2014

(86) PCT No.: PCT/EP2014/059976
§ 371 (c)(1),
(2) Date: Dec. 2, 2015

(87) PCT Pub. No.: WO2014/206637
PCT Pub. Date: Dec. 31, 2014

(65) Prior Publication Data

US 2016/0123329 A1 May 5, 2016

(30) Foreign Application Priority Data

Jun. 24, 2013 (EP) ..... 13173440

(51) Int. Cl.
*F04D 17/12* (2006.01)
*F04D 1/06* (2006.01)
*F04D 29/42* (2006.01)
*F04D 29/62* (2006.01)

(52) U.S. Cl.
CPC ..... *F04D 17/12* (2013.01); *F04D 1/06* (2013.01); *F04D 29/426* (2013.01); *F04D 29/628* (2013.01)

(58) Field of Classification Search
CPC ..... F04D 17/12; F04D 17/125; F04D 1/06; F04D 1/063; F04D 29/628; F04D 29/426; F04D 29/42
See application file for complete search history.

(56) References Cited

U.S. PATENT DOCUMENTS 4,877,372 A * 10/1989 Jensen ..... F04D 1/06 415/199.1
5,253,977 A * 10/1993 Chaix ..... F04D 1/04 29/447
2014/0093409 A1* 4/2014 Tazioli ..... F04D 29/406 417/423.11

FOREIGN PATENT DOCUMENTS

DE 35 23 599 A1 1/1987
DE 37 29 673 A1 3/1989
EP 0 726 397 A1 8/1996
(Continued)

*Primary Examiner* — Christopher Verdier
*Assistant Examiner* — Elton K Wong
(74) *Attorney, Agent, or Firm* — McGlew and Tuttle, P.C.

(57) ABSTRACT

A centrifugal pump (1) includes several pump stages, which are arranged axially between a head part (4) and a foot part (2). The pump stages are surrounded peripherally by an outer casing (3). An axial end of the outer casing (3) is fastened on the head part (4), and the other axial end on the foot part (2). A mechanical connection between the head part (4) and the foot part (2) is formed by the outer casing (3).

6 Claims, 12 Drawing Sheets

(56) References Cited

FOREIGN PATENT DOCUMENTS

| | | | | | |
|---|---|---|---|---|---|
| EP | 1 469 202 | A1 | | 10/2004 | |
| EP | 2 112 380 | A1 | | 10/2009 | |
| EP | 2366905 | A2 | * | 9/2011 | ..... F04D 1/063 |
| EP | 2 469 102 | A1 | | 6/2012 | |
| WO | 01/83996 | A1 | | 11/2001 | |
| WO | WO-2008071592 | A1 | * | 6/2008 | ..... F04D 1/063 |

* cited by examiner 3
32
31
27
29
7
2
30
17
11

35
34
36
28
28
33
34
35
31
11
A
C
B
27

CENTRIFUGAL PUMP

CROSS REFERENCE TO RELATED APPLICATIONS

This application is a United States National Phase Application of International Application PCT/EP2014/059976 filed May 15, 2014 and claims the benefit of priority under 35 U.S.C. § 119 of European Patent Application 13 173 440.2 filed Jun. 24, 2013 the entire contents of which are incorporated herein by reference.

FIELD OF THE INVENTION

The invention relates to a centrifugal pump with several pump stages.

BACKGROUND OF THE INVENTION

Multi-stage centrifugal pumps are known, with which several pump stages, in each case consisting of a pump impeller and a spiral housing which surrounds this, are arranged between a head part and a foot part, wherein the impellers are arranged on a common shaft. Thereby, the head part and foot part amid the inclusion of the pump stages are connected to one another via outer-lying tie rods in the form of screws.

Such a centrifugal pump typically comprises four screws, which run on the outside along the pump stages. Thereby, embodiments are known, with which the spiral housing in the region of the pump stages form the outer casing or such, with which a fluid return is effected within the housing, typically to the foot part, and which comprise an outer casing which forms an annular channel between the outer sides of the spiral housing and the outer casing, via which annular channel the delivery fluid flows from the head part to the foot part or, as the case may be, also vice versa.

Common to both embodiments is the fact that the screws, with which the head part and foot part are clamped amid the inclusion of the pump stages or, as the case may be, of the outer casing surrounding these, bear in the region of the head part and foot part, but have a certain distance in the region of the pump stages. The latter fact leads to the fact that the temperature of the screws can differ significantly from that of the delivery fluid and thus also that of the spiral housing or of the outer casing, which leads to thermal stresses within the centrifugal pump. Such thermal stresses can also lead to premature wear or failure of the pump.

A further disadvantage of this construction type is the fact that not only the shaft and, as the case may be, the outer casing must be provided in different lengths depending on the number of pump stages, but also that the screws connecting the head part and foot part must be provided in different lengths, in order depending on the number of pump stages, to connect the head part and foot part amid the inclusion of the pump stages.

SUMMARY OF THE INVENTION

Against this background, it is the object of the invention to design a multistage centrifugal pump which on the one hand avoids, or at the minimum reduces thermal stresses within the pump, and on the other hand the variety of components is reduced with the construction of construction series having a different stage number.

The centrifugal pump according to the invention comprises several pump stages which are arranged axially between a head part and a foot part. It furthermore comprises an outer casing which peripherally surrounds the pump stages. According to the invention, an axial end of the outer casing is fastened on the head part, and the other axial end on the foot part of the centrifugal pump, wherein the mechanical connection between the head part and foot part is formed by the outer casing.

The basic concept of the solution according to the invention is thus to utilise the outer casing which as a rule is present in any case, for clamping the pump stages between the head part and foot part. The outer casing thus forms the mechanical connection between the head part and the foot part. The axial ends of the outer casing therefore according to the invention are fixedly, preferably however releasably fastened on the foot part and on the head part, in an indirect or direct manner. The otherwise necessary tie rods can be done away with in this manner. The outer casing, if this forms the annular return channel within the centrifugal pump, is always subjected to the temperature level of the delivery fluid, so that thermal stresses are largely avoided, since the outer casing and pump stages as well as head part and foot part always have the same temperature level. With embodiments which comprise the outer casing only for fastening purposes, with which therefore no annular channel is formed, the outer casing is usefully designed bearing on the pump stages, i.e. on the outer side of the spiral housing, in order where possible to create a thermally conductive connection to these.

Thereby, in the simplest form, the outer casing can have a cylindrical shape and be radially clamped in the head part and foot part or be firmly connected to the head part or foot part via essentially radially arranged screws. These screws can for example by led through corresponding bores which are arranged distributed over the periphery of the outer casing at its end, and be fixed in the head part or foot part.

It is particularly advantageous if the outer casing is connected to the foot part and/or to the head part with a positive fit by way of integrating at least one ring. The advantage of such a connection, with which the positive fit is formed by a typically open ring integrated between the components, lies in the fact that the components are quite simple to assembly, since without the ring, they have a tolerance with regard to the diameter such that they can be stuck into one another. The actual positive-fit connection is not effected until integrating this ring. Thereby, it is particularly advantageous that the forces are introduced via the ring over almost the entire periphery and in a uniform manner from the foot part or the head part onto the outer casing or vice versa. Due to fact that the components bear on one another over almost the complete periphery, a very good heat transfer between the components is effected at least when these are of metal, which is very generally the case, so that one can assume a uniform temperature level within the centrifugal pump. The ring integrated between the components is advantageously not designed as a closed ring, but as an open ring, so that by way of slight expanding or widening open, it can be easily assembled also over components which are larger than the inner diameter of the ring or can also be integrated into components which are smaller than the outer diameter of the ring, if this is suitably pressed together. One could also apply a multi-part ring instead of the single-part ring, which can be advantageous with regard to the assembly Preferably, but not necessarily, the tubular outer casing is formed from sheet metal. This is designed in a radially widened manner at its axial ends, since a uniform, simple as well as effective fastening is possible by way of this, and on the other hand the assembly also is very simple if e.g. a funnel-like receiver results, which permits a simple assembly on the outer periphery of the pump stages. The widening can thereby be effected radially outwards or radially inwards or in both directions, preferably by way of plastic forming such as rolling, deep-drawing, compression, crimping or likewise.

The fastening of the outer casing in the head part or in the foot part is effected particularly advantageously if a projection which is directed radially inwards and is peripheral at least in sections, is provided on the foot part and/or on the head part. This projection is usefully designed such that the axial, as the case may be widened out end of the outer casing can only just be led through, and the desired positive-fit, in particular in the axial direction, is not effected until after the integration of the ring. Such a projection can be provided in a direct manner if the head part or the foot part is manufactured from cast metal. However, it is also conceivable to form the projection by way of a separate, single-part or multi-part annular component which is fastened on the head part or on the foot part, typically fastened by screw. Such a projection can be formed peripherally about 360°, if it is formed by a flange which is screw-fastened on the head part or on the foot part, typically on an axial face side.

Such a flange can be formed as one piece, but also in a multi-part manner. In the latter case, it is advantageous if the individual flange parts are designed identically e.g. by way of two identical flange halves.

Advantageously, the ring which creates the positive fit between the head part and the outer casing or the foot part and outer casing, can also be designed in a multi-part manner. It is then useful to divide the ring such that all parts are designed in an identical inner, i.e. to provide two identical ring halves.

Apart from any grooves for integrating O-rings between the outer casing and the head part or the outer casing and foot part, the outer casing advantageously on at least one end comprises a peripheral, radially outwardly open groove which serves for integration of the ring, with which ring the positive fit between the outer casing and the head part or the outer casing and the foot part is created. If the outer casing is formed from sheet metal, such a groove can be formed by way of shaping in this region.

Moreover, the head part and foot part advantageously likewise comprise a peripheral, but radially inwardly open groove which is for receiving the ring and which is advantageously arranged such that in the installed condition, it lies opposite the groove at the end of the outer casing or, seen from the outer casing to the head part or foot part, is arranged in front of the radially widened end of the outer casing. This arrangement ensures that the ring which is to be integrated therein holds the widened end of the outer casing within the head part or foot part with a positive fit. Such a groove, with a cast part is either shaped in from the very beginning, which is inexpensive, or however is created in a material-removing manner as the case may be. Finally, such a groove can also be formed by way of screw-fastening a flange on an axial side of the head part or foot part. It is particularly advantageous if means for the radial displacement of the ring are provided on the head part and/or on the foot part. With such means it is possible to move the ring already integrated between the components, from a non-locking into a locking position or vice versa. Thereby, a radial displacement in the context of the invention is not only to be understood as a spatial displacement of the ring or of ring parts, but in particular also a change of the diameter of the ring by way of compression or expanding. The latter however assumes that the ring is at least open or of several parts.

Such means for displacement can for example be formed by way of threaded screws which are arranged preferably radially on the head part and/or foot part, are accessible from the outside and each led in a threaded bore which runs out in the inwardly open groove. A ring integrated into the inwardly open groove can be displaced radially inwards or pushed together with such comparatively simple adjusting screws in order to engage into the oppositely lying groove of the outer casing or to project up to the outer casing at least so far that the widening located therebehind is held with a positive fit. If, as is advantageous, the ring is designed as an open spring ring, then a disassembly can be effected by way of rotating out these threaded screws, since the ring then automatically springs back into its initial position If, as is advantageous, an open spring ring is provided as a ring for the positive connection between the head part and outer casing or between the foot part and the outer casing, then the ring diameter can be changed solely by way of adjusting the distance of the ring ends. Thus advantageously means for setting this distance can be provided on the head part and/or foot part, in order with few hand grips to create the positive fit and also release it again as the case may be.

According to an advantageous further development of the invention, an auxiliary ring is provided, with which the ring can be brought into its locking position, wherein means for moving the auxiliary ring are provided on or in the foot part or head part. The arrangement of such an auxiliary ring has the advantage that the actual ring which is provided for fastening between the head part and outer casing or the foot part and outer casing, is not loaded in a point-wise manner by way of screws or similar bodies, but only by way of this auxiliary ring, which otherwise however hardly needs to accommodate forces. The auxiliary ring thus exclusively serves for bringing the ring into its locking or unlocking position and holding it there.

Positive-fit means which hold the outer casing on the foot part or on the head part in a rotationally fixed manner are preferably provided at the axial end of the outer casing. Such positive-fit means can be provided by way of a tongue/groove arrangement in the region of the widened part on the outer periphery of the outer casing as well as on the corresponding inner side of the respective receiver of the head part or foot part. Thus, for example, axis-parallel recesses can be arranged distributed over the periphery in the widened part of the outer casing, which engage into corresponding projections in the associated receiver of the head part or foot part. These components ensure a rotationally fixed connection between the head part and the outer casing or the foot part and the outer casing.

The invention is hereinafter explained in more detail by way of embodiment examples represented in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
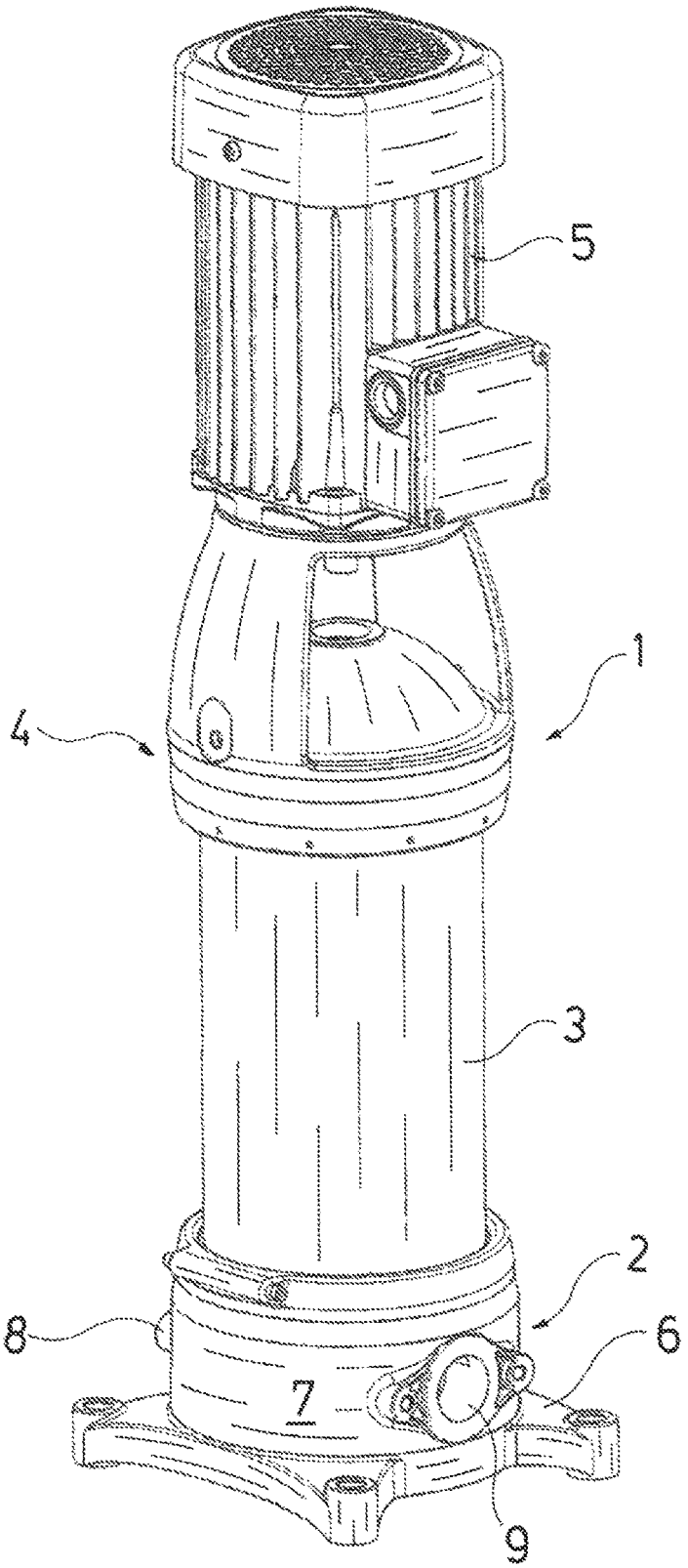
FIG. 1 is a simplified perspective view of a centrifugal pump assembly according to the invention with different fastenings of the head part and foot part.
Figure 2:
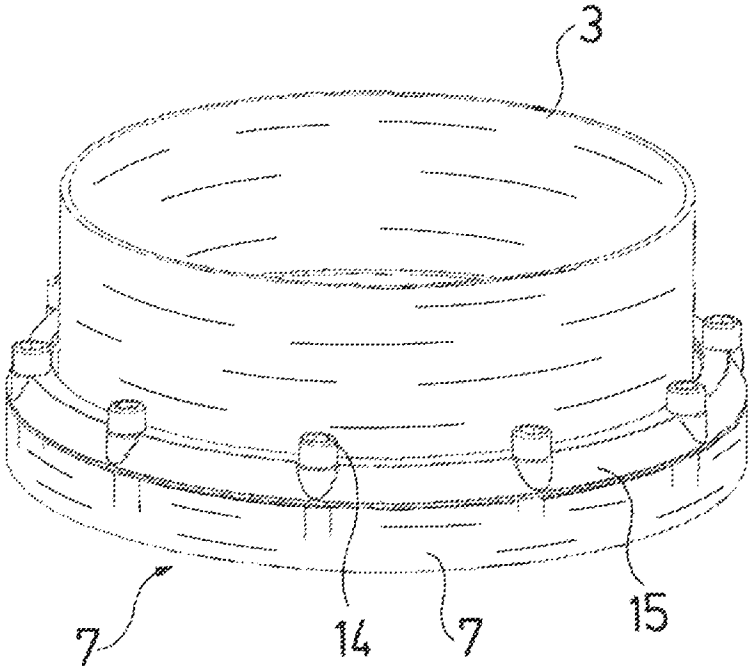
FIG. 2 is a perspective view of an embodiment of the fastening of an axial outer casing end on the foot part.

With regard to the represented centrifugal pump 1, it is the case of a multi-stage inline pump. The centrifugal pump 1 is envisaged for upright operation and it comprises a foot part 2, to which an outer casing 3 connects to the top, the upper end of said outer casing being received by a head part 4 which simultaneously forms a motor base for the electrical drive motor 5 arranged thereabove. The construction of the pump represented in FIG. 1 corresponds to the basic construction of such vertical, multistage high pressure centrifugal pumps of the inline construction manner, as are manufactured and offered for example by the company Grundfos under the type description CR or CRE.

The foot part 2 consisting of cast metal comprises a lower plate 6 which is formed with this as one piece, forms the actual foot of the centrifugal pump 1 and with which the centrifugal pump 1 stands on the base and can be screw-fastened to the base via bores located in the plate 6. The foot part 2 moreover has the shape of a cylindrical tube 7 with a vertical axis which on its outer periphery comprises two connection flanges 8 and 9 which are arranged lying opposite and away from one another, of which one forms the suction connection and the other the pressure connection of the pump 1. The fluid to be delivered gets via the suction connection into the foot part 2 and from there in a consecutive manner into the pump stages which connect vertically thereto and in each case consist of spiral housing and an impeller. Thereby, the arrangement is such that the exit of the lower spiral housing is conductively connected to the entry of the pump stage lying thereabove, and the exit of the last, i.e. the uppermost pump stage is connected via an annular channel to the pressure connection in the foot part 2. The annular channel on the one hand is delimited by the peripheral sides of the spiral housing which is not visible in FIG. 1 and on the other hand by the outer casing 3 which is cylindrical in this region. The impellers of pump stages are seated on a common shaft which is driven by the drive motor 5 arranged on the head part 4 of the centrifugal pump 1.

Even if the present invention is described by way of a vertical, multi-stage centrifugal pump, it is however not restricted to the vertical arrangement.

The mechanical connection between the head part 4 and the foot part 2, with the represented centrifugal pump 1 is effected via the outer casing 3. The outer casing 3 which is arranged coaxially to the rotation axis and the shaft of the centrifugal pump has the shape of a cylindrical tube, but is designed in a widened manner at the axial ends for fastening in the head part 4 or in the foot part 2. The variants described hereinafter, with which in each case the axial upper end of the foot part and the lower end of the outer casing 3 which engages therein, can be used in the same manner for the connection between the head part and the outer casing. Advantageously, the same connection parts and components are selected for both connections. This however is not absolutely necessary, and different connections can also be effected as the case may be, as is represented by way of example in FIG. 1, where the connection between the foot part and the outer casing corresponds to that described by way of FIGS. 9 to 11, whereas the connection between the head part and the outer casing corresponds to that described by way of FIGS. 12 to 13.

Figure 3:
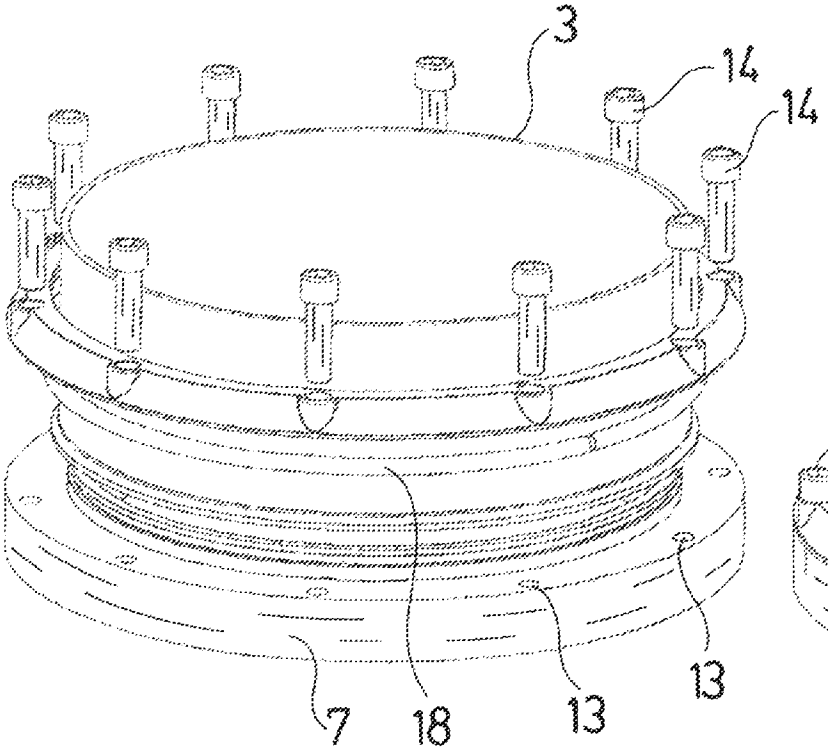
FIG. 3 is an exploded representation showing the connection of FIG. 2.
Figure 4:
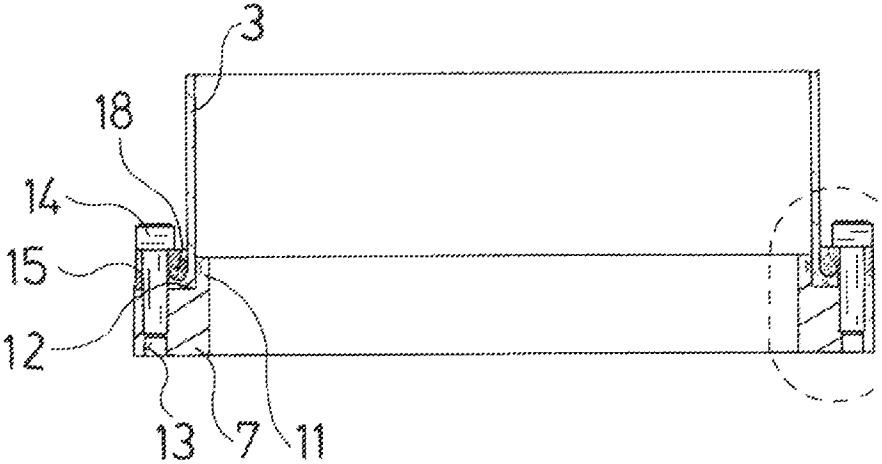
FIG. 4 is a longitudinal sectional view through the connection according to FIG. 2.
Figure 5:
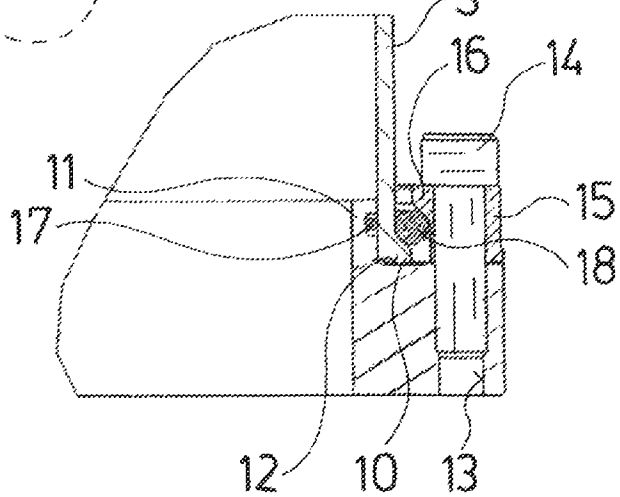
FIG. 5 is a greatly enlarged sectional view showing a detail V in FIG. 4.

With regard to the embodiment represented by way of FIGS. 3 to 5, the axial end of the outer casing 3 is widened or expanded radially outwards. The outer casing 3 formed from sheet metal is compressed there into a peripheral bead 10. The tubular part 7 of the foot part 2 is designed in a stepped cylindrical manner to its upper axial end. It comprises an inner part 11 which delimits the peripheral axial surface 12 to the inside. Bores 13 are arranged distributed on the annular surface 12 and serve for receiving fastening screws 14 which serve for fixing a flange 15 having an annular cylindrical shape with a bead 16 projecting radially inwards. As is particularly visible in FIG. 5 the projecting inner part 11 serves for guiding the axial end of the outer casing 3 on the inner side. A peripheral groove for an O-ring 17 is provided there, with which O-ring the outer casing 3 is sealed with respect to the inner part 11 and thus with respect to the foot part 2. The outer periphery of the bead 10 at the end of the outer casing 3 is slightly smaller than the inner periphery of the bead 16 on the flange 15, so that the flange 15 can be pushed over the end of the outer casing.

A ring 18 is provided to achieve a positive-fit connection between these components. This ring 18, as is particularly evident from FIG. 3, is open, so that after the flange 15 has been pushed over the end of the outer casing 3, by way of bending open, in its diameter it is resiliently enlarged to such an extent that it can be pushed over the bead 10. This ring 18 then springs back and bears with a non-positive fit on the cylindrical part of the outer casing 3. If now the flange 15 is fastened by way of the screws 14 in the bores 13 and thus on the foot, 2, this ring 18 is pushed between the beads 10 and 16, as is represented in FIG. 5. The beads 10 and 16 for this comprise corresponding oblique surfaces, so that the ring 18 can bear non-positively between these beads. This ring 18 now forms a positive fit between the flange 15 and the widened end of the outer casing 3 and thus fixes this in the foot part 2 with a positive and non-positive fit.

It is evident that a very uniform force introduction over the whole periphery is effected by way of this. Moreover, due to the ring 18 formed from spring steel, the metallic flange 15, the outer casing 3 formed from sheet metal and the foot part 2 consisting of cast metal bear on one another in a tight and thermally conductive manner, so that these always roughly have the same temperature level in operation.

The release of the connection is effected in the reverse direction, i.e. after releasing the screws 14, the flange 15 is firstly lifted upwards until the ring 18 is accessible. This is then bent open, pushed over the bead 10 at the end of the outer casing 3, whereupon the outer casing 3 is pulled upwards out of the foot part 2.

Figure 6:
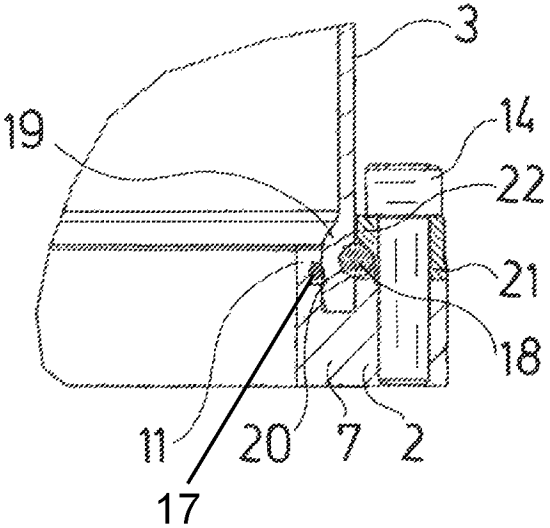
FIG. 6 is a sectional view of an alternative to the fastening according to FIG. 5.
Figure 8:
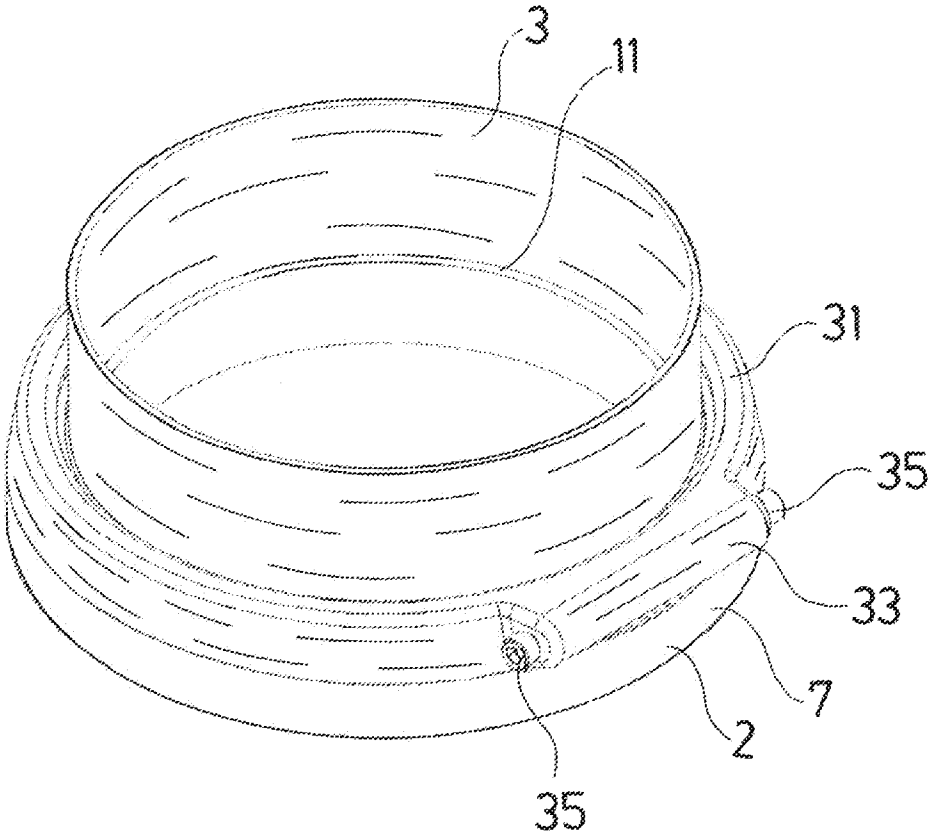
FIG. 8 is a perspective view of a further embodiment example, in a representation according to FIG. 2.

With the embodiment variant represented by way of FIG. 6, the axial end of the outer casing 3 is widened radially inwards and there comprises a peripheral bead 19 which bears on the inner part 11 amid the integration of an O-ring 17 sealing this component. The outer casing 3 is designed in a cylindrical manner on its outer side up to the end, but comprises a peripheral groove 20 which is semicircular in cross section and is envisaged for integration of the ring 18 forming the positive fit between the end of the outer casing 3 and the foot part 2 with the flange 21, said flange likewise comprising a radially inwardly projecting and peripheral bead 22 which however in contrast to the bead 16 reaches directly up to the outer side of the outer casing 3. On the outer casing side, the ring 18 is fixed in the groove 20 with a positive fit, and on the flange side by way of the bead 22.

Figure 7:
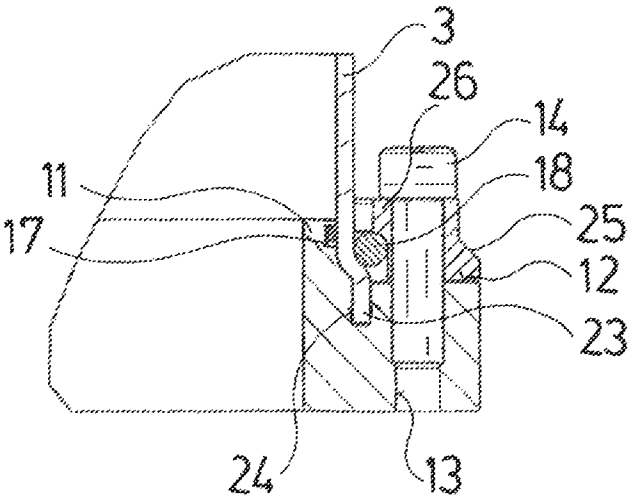
FIG. 7 is a sectional view of a further embodiment, in the representation according to FIG. 5.

With regard to the embodiment variant represented by way of FIG. 7, the outer casing 3 is designed in a widened manner at its axial end 23, but not in a compressed manner, as with the previously described embodiments. The outer casing 3 thus also in the widened region 23 has essentially the same material thickness as in the remaining region. This widened end 23 of the outer casing 3 lies in a peripheral groove 24 in the axial surface 12. The transition between the groove 24 and the inner part 11 which radially inwardly supports the axial end of the outer casing 3 is also designed in an accordingly adapted manner. The sealing between the outer casing 3 and the foot part here is also effected by way of an O-ring 17 which lies in a peripheral groove on the outer periphery of the inner part 11 and bears on the inner side of the outer casing 3. A flange 25 is fastened in bores 13 by way of screws 14, amid the integration of the ring 18 and this fixes the outer casing 3 in the foot part 2. The flange 25 here has an outwardly obliquely stepped shape. At the inner side it comprises a bead 26, with which it holds the ring 18 with a positive but also non-positive fit.

With all previously described embodiments, the assembly of the connection is effected in a manner such that firstly the respective flange is pushed over the axial end of the outer casing, whereupon the ring 18 is pushed onto this end, and the axial end is brought into its correctly envisaged position in the foot part 2. Then the flange is fastened in the bores 13 by way of screws 14, whereupon the connection is fixed positively and non-positively. The release is effected in the reverse sequence.

With the embodiment described by way of FIGS. 8 to 11, a ring 27 likewise consisting of spring steel is provided and this has a rectangular cross section and its end are bent away radially outwards. Thus, here too, it is the case of an open ring, whose ends 28 are bent radially outwards for an improved force introduction. The axial end of the outer casing 3 is likewise widened, but only radially outwards. Thus, a bead 29 which is rectangular in cross section and projects radially outwards is formed on the end of the outer casing 3. The upper axial end of the foot part 2 comprises an inner part 11 which supports the outer casing 3 at the inner side. A cylindrical outer part 31 comprising an inner-peripheral rectangular groove 32 which is open radially inwards and whose shape corresponds to the cross sectional shape of the ring 27, extends from the placement surface 30 in a manner projecting beyond the inner part 11. The cylindrical outer part 31 at one side comprises a projecting flattened part 33, in which two roughly tangentially arranged threaded bores 34 are incorporated, in which bores set screws 35 are seated, the end of which in a free space 36 formed there meet the ends 28 of the ring 27 and specifically in a manner such that the ends 28 are moved to one another on rotating the set screws 35 into the foot part 2, whereas these drift apart due to the spring force of the ring 28 on rotating out.

Figures 10, 11:
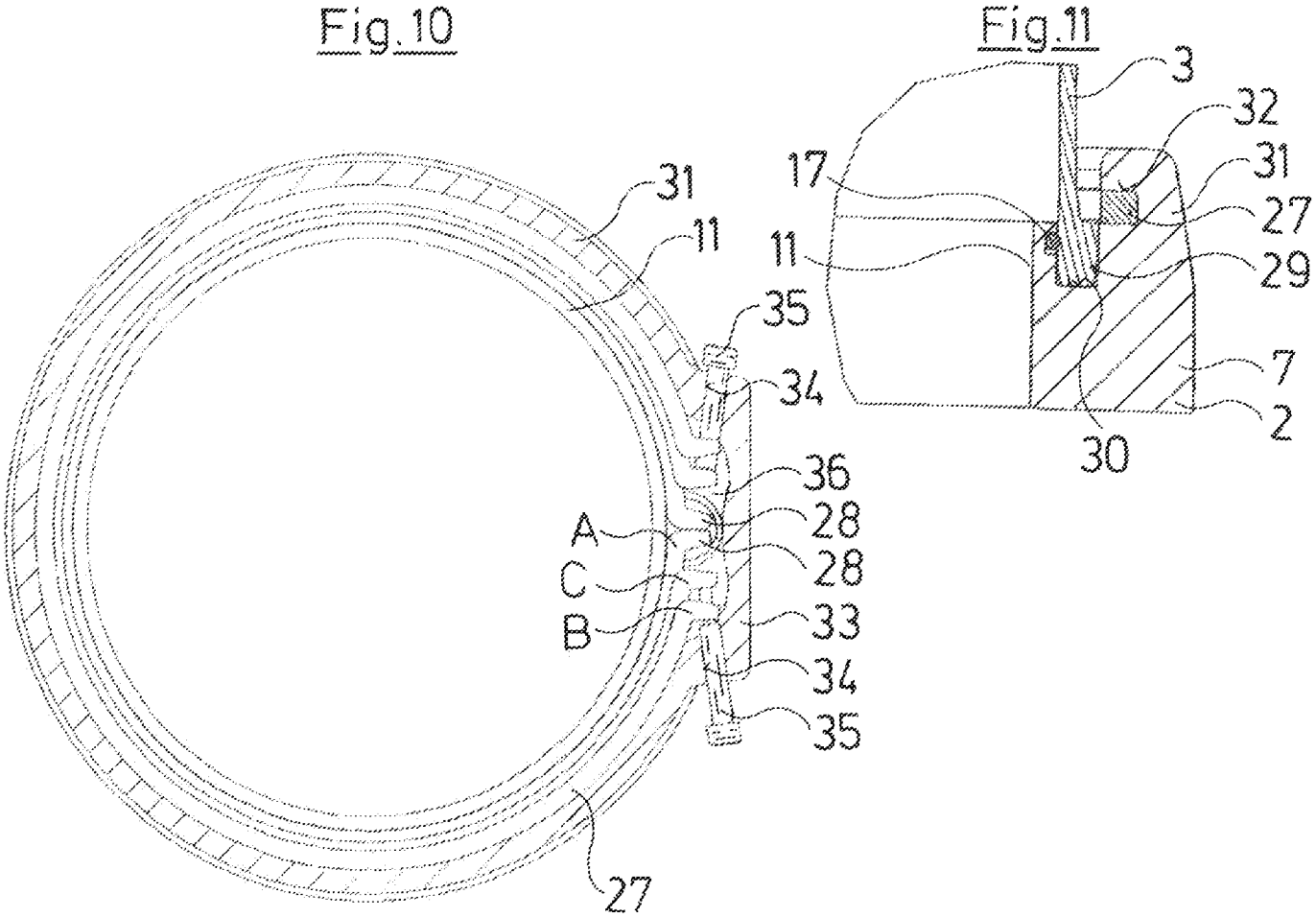
FIG. 10 is a cross sectional view with three different positions of the ring.
FIG. 11 is a sectional view of the connection according to FIG. 10 in an unlocked position, in the representation according to FIG. 5.

The ring 27 is represented in FIG. 10 in three different positions, in a position A, in which the ring 27 has its smallest diameter and the ends 28 almost bear on one another, a position B, in which the ring 27 has its greatest diameter and as a result the ends 28 have the greatest distance to one another, and a position C between the positions A and B. The ring 27 is maximally tensioned in the position A, and is almost relaxed in the position B.

For the assembly, the ring 27 is firstly introduced from above into the annular opening open from the top, between the inner part 11 and the cylindrical outer part 31, and specifically up to the height of the groove 32. The ring 27 is held in this position A by a tool which grips the ends 28 and holds them in this position, or an assembly holder which is provided for this. As soon as the ring 27 lies in the region of the groove 32, the assembly holder is removed, so that the ring 27, with the set screws 35 not yet screwed in, springs back into its position B, in which the ring 27 lies completely within the groove 32, and the ends 28 are arranged in the free space 36. Then the widened end of the outer casing 3 with its bead 29 is likewise introduced from above into the foot part 2, until the face side comes to bear on the placement surface 30. The constellation represented in FIG. 11 then results. In order to now connect the components to one another with a positive fit, the set screws 35 are rotated in up to the envisaged position, in which the ring 27 assumes the position C, i.e. lies with a part within the groove 32 and with another part within the free space open to the top, and thus blocks the bead 29 at the end of the outer casing 3 from moving upwards out of the intermediate space.

For opening the connection, the set screws 35 are to be rotated out, until the ring 27 again lies in the position B, i.e.

lies completely in the groove 32, so that the outer casing 3 can be pulled out of the foot part 2.

Figure 9:
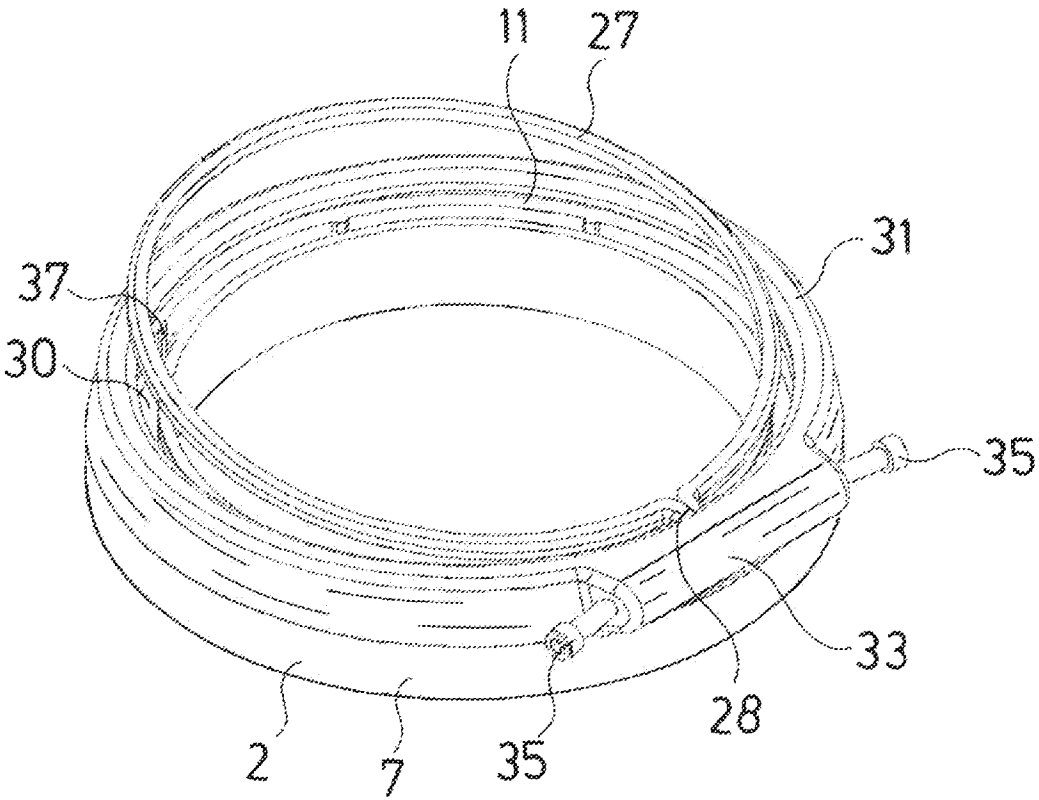
FIG. 9 is an exploded view showing the embodiment according to FIG. 8.

As is evident from FIG. 9, perpendicular projections 37 are arranged on the inner side of the cylindrical outer part 31 below the groove 32 and engage into corresponding perpendicular recesses (41 in FIG. 12) in the bead 29 of the outer casing and thus form a positive-fit rotational lock between the outer casing 3 and the foot part 2.

Figure 13:
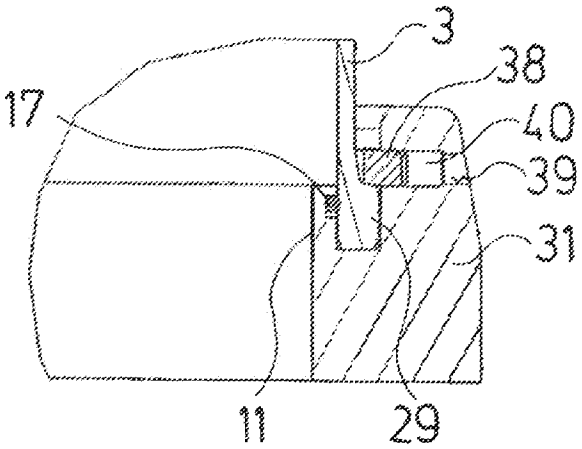
FIG. 13 is a sectional view of the connection in the joined together condition, in a representation according to FIG. 5.
Figure 12:
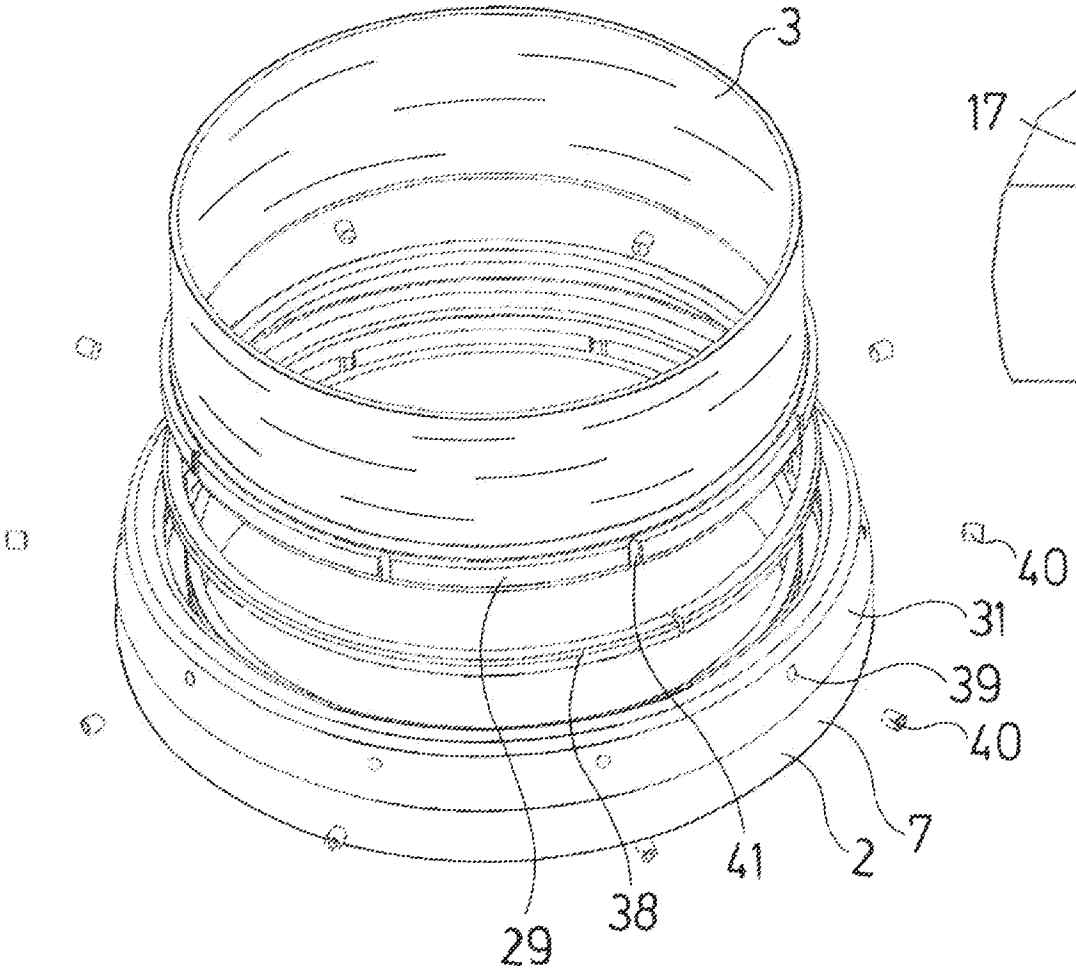
FIG. 12 is an exploded view showing a further embodiment example in a representation according to FIG. 3.
Figure 15:
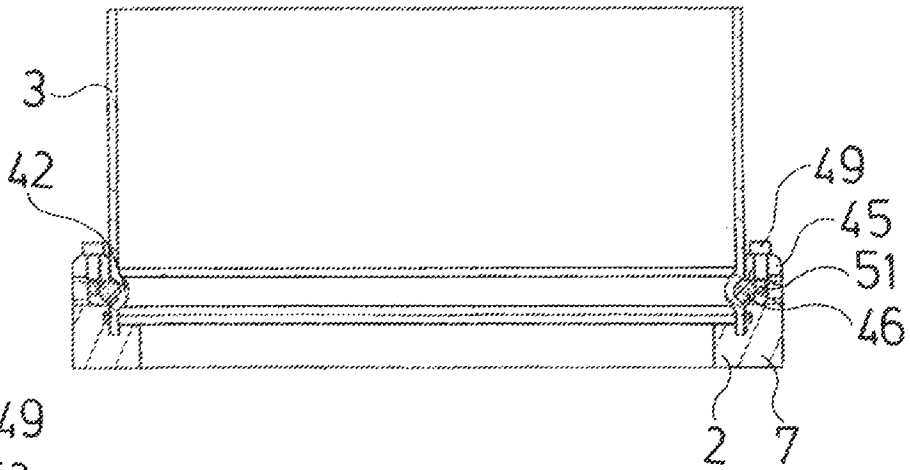
FIG. 15 is a longitudinal sectional view of the embodiment according to FIG. 14, in a representation according to FIG. 4.
Figure 14:
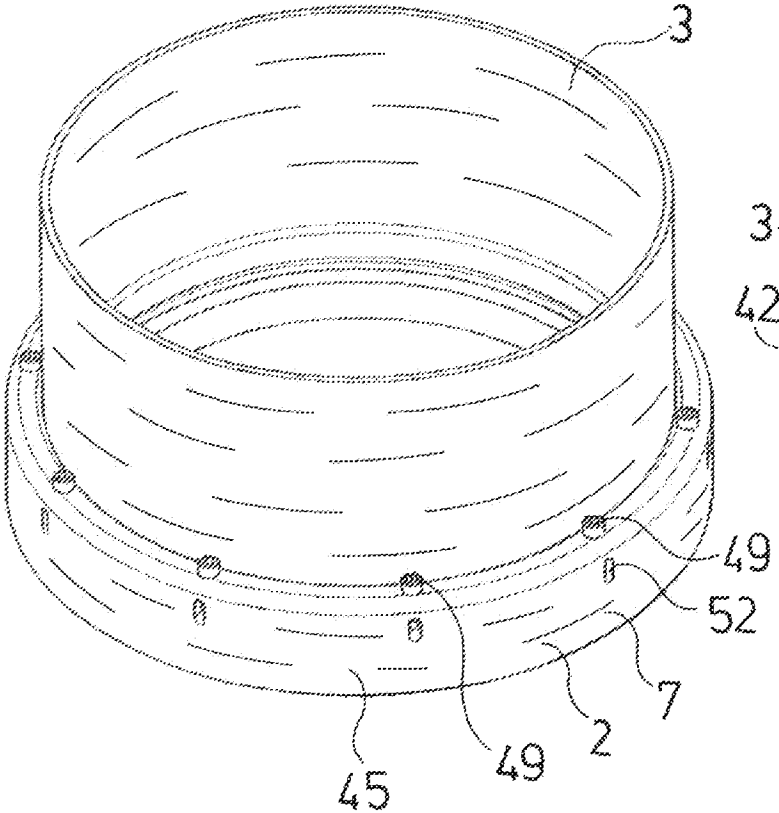
FIG. 14 is a perspective view of another embodiment example of the fastening of the outer casing in the foot part, in the representation according to FIG. 2.

The embodiment variants represented by way of FIGS. 12 and 13 differ from the previously described ones in that a ring 38 is provided which has the same rectangular cross section as the ring 27 but is not radially bent away at its ends, but is designed as an open spring ring. Moreover, the cylindrical outer part 31 does not comprise the flattened part 33 with the set screws 35, but a multitude of radial threaded bores 39 which pass through the cylindrical outer part 31 and run out at the base of the groove 32.

With this embodiment, the setting of the wideness of the ring 38 is effected via radial screws 40 which are seated in the threaded bores 39 and with which the ring 38 is brought out of the position represented in FIG. 11, in which it lies completely in the groove 32, into the position represented in FIG. 13, in which the ring 38 lies roughly by half within the groove 32 and otherwise projects radially inwards and this secures the bead 29 against movement upwards, with a positive fit. With this embodiment too, projections for the rotation locking between the outer casing 3 and the foot part 2 are provided. The corresponding recesses 41 in the bead 29 are clearly evident.

With regard to the embodiment variant represented by way of FIGS. 14 to 17, the widened end 42 of the outer casing 3 is widened radially inwards and by way of this forms a groove 43 which is part-circular in cross section, for integrating a ring 46 of a round cross section. The ring 46 is a part-open spring ring and is similar to that previously described. The axially upper end of the foot part 2 here comprises a peripheral groove 44 which is open to the top and which is envisaged for receiving the free end of the outer casing 3. Here too, a cylindrical outer part 45 is provided, and this projects at one side and comprises a lower peripheral groove with an O-ring 17 for sealing, here on the outer side of the outer casing 3.

The cylindrical outer part 45 has a radially inwardly directed groove 47 which is arranged lying opposite the groove 43 in the installed condition. Moreover, the cylindrical outer part 45 in its upper side comprises a multitude of threaded bores 48, in which threaded screws 49 are sealed, which are axis-parallel to the impeller axis. These threaded bores 48 run out at the groove base of a groove 50 which extends upwards within a radial groove 47 and which is envisaged for receiving an auxiliary ring 51.

Figure 17:
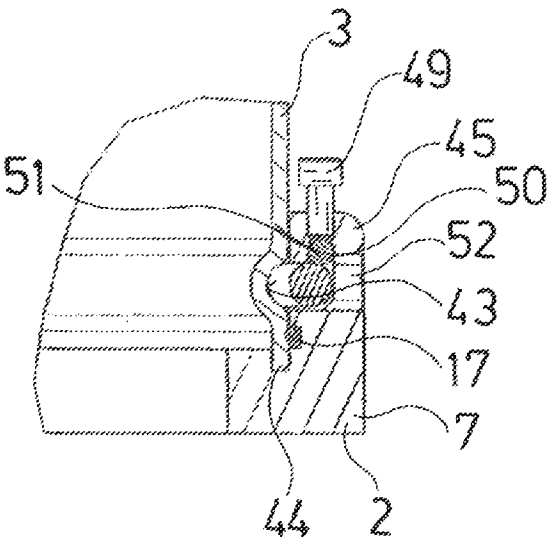
FIG. 17 is a sectional view of the connection according to FIGS. 14-15 in the unlocked condition, in a representation according to FIG. 5.
Figure 16:
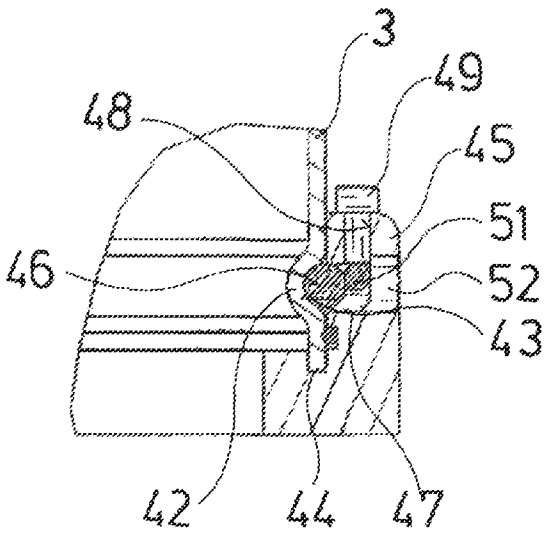
FIG. 16 is a sectional view of the connection according to the FIGS. 14-15 in the locked condition, in a representation according to FIG. 5.
Figure 19:
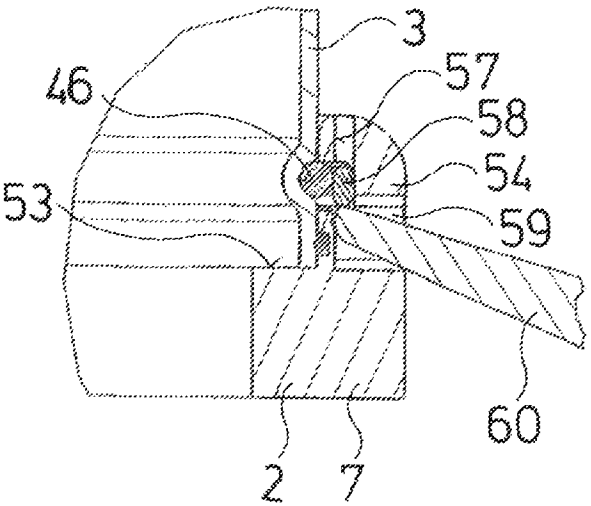
FIG. 19 is a sectional view of the connection according to FIG. 18, in a representation according to FIG. 5 with an inserted tool.
Figure 18:
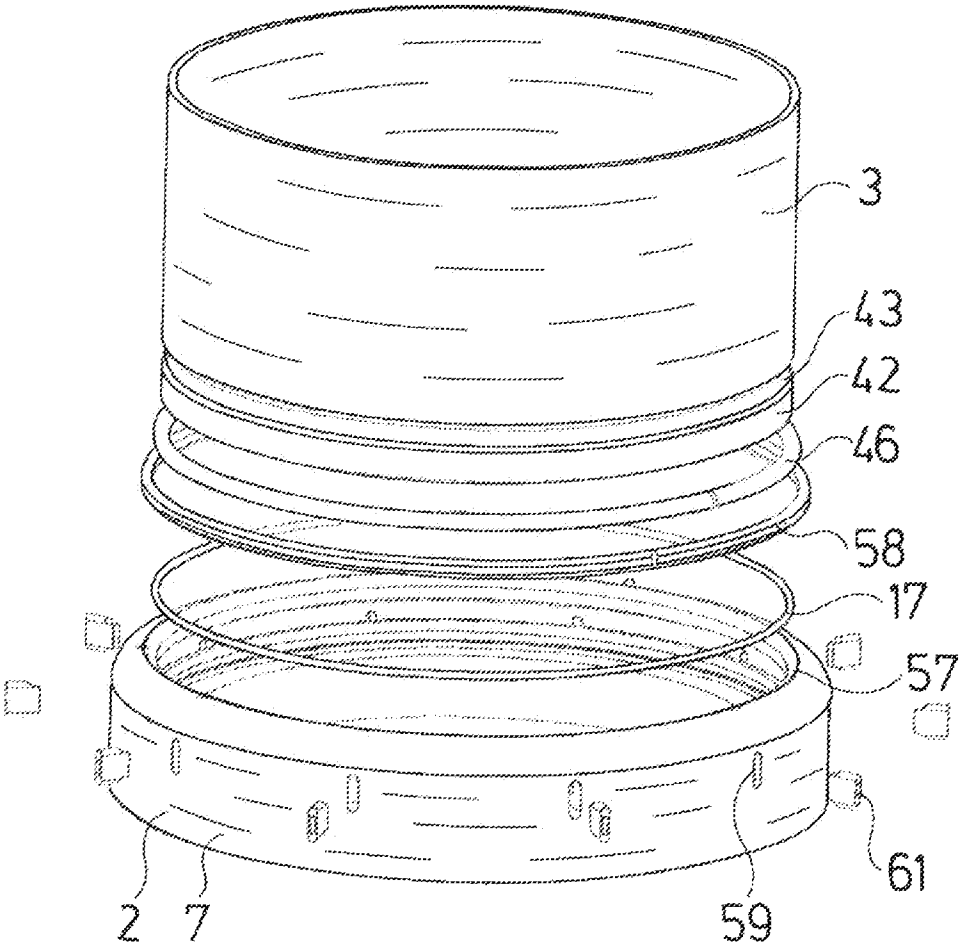
FIG. 18 is an exploded view of a further embodiment example in a representation according to FIG. 3.

The ring 46 in this embodiment variant is dimensioned such that on account of its inherent tension in the expanded position, it bears within the radial groove 47, as is represented by way of FIG. 17. In this position, the axial end of the outer casing 3 can be inserted into the foot part 2 until the end comes to bear in the groove 44. In this position, the screws 49 are rotated in, by which means the auxiliary ring 51 which on account of its smaller diameter with respect to the ring 46, displaces this radial inwards, so that this assumes the locking position represented in FIG. 16, in which the ring 46 by half is arranged in the groove 43 in the widened end 42 of the outer casing 3 and with the other half is arranged in the radial groove 47 of the cylindrical outer part 45. The auxiliary ring 51 is arranged directly next to it, so that the ring 46 is positively held in this position.

The screws 49 are first to be released for releasing the connection. Elongate holes 52 are provided on the peripheral side in the cylindrical outer part 45, in order to move the auxiliary ring 51 out of its blocking position (FIG. 16), and these elongate holes run out at the base of the radial groove 47. An auxiliary instrument, for example a screwdriver, with which the auxiliary ring 51 can be levered upwards, can be introduced through these elongate holes from the outside, whereupon the ring 46 springs open and releases the positive fit with the widened end 42.

A further embodiment variant is represented by way of FIGS. 18 to 21 and this on the outer casing side corresponds to the previously described embodiment, but is designed differently on the foot part side. On the foot part side, a placement surface 53 is provided, which extends roughly over half the width of the hollow-cylindrical component 7. A cylindrical outer part 54 which comprises a radially inwardly open groove 55 lying opposite the groove 43 in the installed position, as well as a peripheral groove 56 connecting thereto to the bottom and open to the groove 55, extends upwards from this placement surface. Perpendicular bores 57 which run out in the radial groove 55 and are aligned to the groove 56 are moreover provided.

Figure 20:
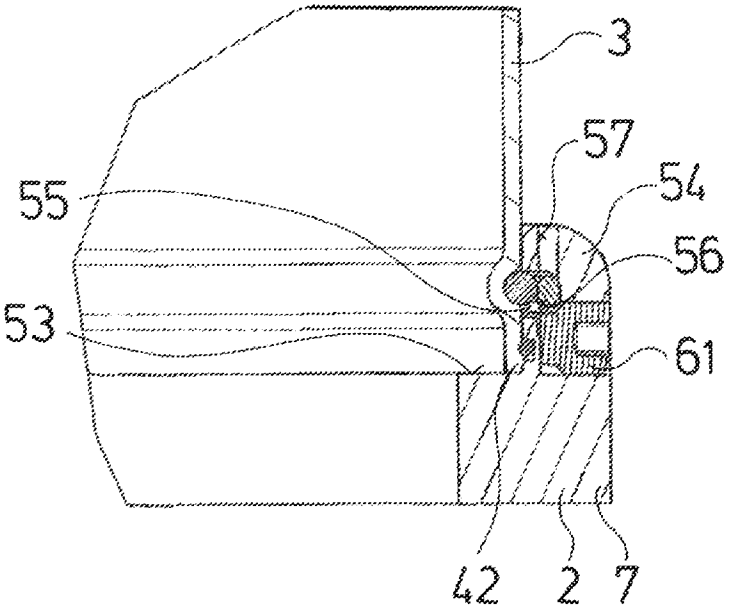
FIG. 20 is a sectional view of the connection according to FIG. 18 in a locked condition, in a representation according to FIG. 5.

An auxiliary ring 58 which is oval in cross section is inserted into the groove 56 which is open to the top, whereupon the ring 46 is brought into the radial groove 55, in which it bears in an expanded manner due to inherent tension. In this position, the widened end 42 of the outer casing 3 is inserted into the foot part 2, until it bears on the placement surface 53. The position represented in FIG. 21 then results. For locking, the auxiliary ring 58 then by way of an auxiliary instrument 60 is levered upwards through elongate holes 59 provided radially in the cylindrical outer part 54. Due to the fact that the auxiliary ring 58 in the upper region has a smaller diameter than the ring 46, it thereby displaces this inwards. As soon as the auxiliary ring 58 has been brought into the position which is represented in FIG. 20 and which supports the ring 46 from the outside, and in which the ring 46 locks the components 2 and 3 to one another, plugs 61 are introduced into the elongate holes 59 from the outside and these remain in these elongate holes with a non-positive fit and their ends support the auxiliary ring 58 on the lower side and thus secure it against a displacement into the position releasing the ring 46.

Figure 21:
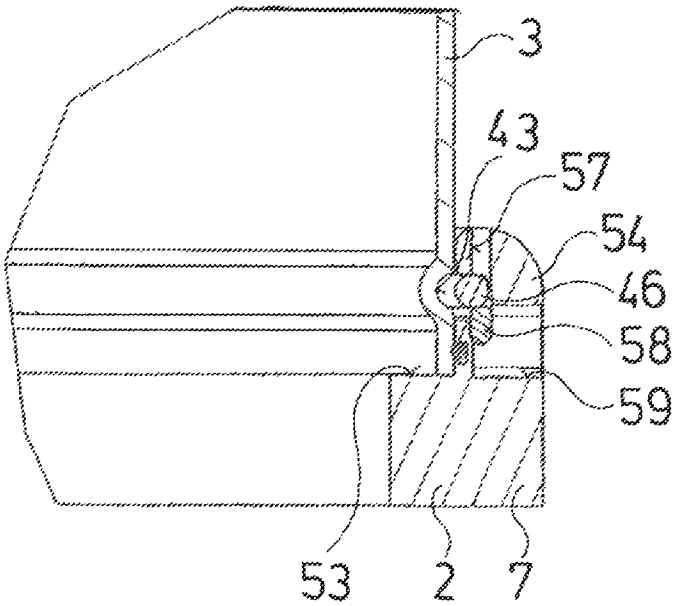
FIG. 21 is a sectional view of the connection according to FIG. 18 in an unlocked position, in a representation according to FIG. 5.

The plugs 61 are removed from the elongate holes 59 by way of inserting a suitable tool, for releasing the connection. Thus, the auxiliary ring 58 is pressed downwards with a pin or spike through the bores 57, until the ring 46 again assumes the unlocking position which is represented in FIG. 21 and in which the outer casing 3 can be removed from the foot part 2.

While specific embodiments of the invention have been shown and described in detail to illustrate the application of the principles of the invention, it will be understood that the invention may be embodied otherwise without departing from such principles.

The invention claimed is:

1. A centrifugal pump comprising:

a head part;

a foot part;

a plurality of pump stages, which are arranged axially between the head part and the foot part;

a fastener;

an outer casing which peripherally surrounds the pump stages, wherein an axial end of the outer casing is fastened on the head part and the other axial end of the outer casing on the foot part, wherein a mechanical connection between the head part and the foot part is formed by the outer casing, wherein the outer casing comprises an outer casing radius, the outer casing radius being constant in an area adjacent to at least one end of the outer casing, wherein the outer casing radius increases at the least one end, at least the fastener connecting the outer casing to the foot part, the fastener being located at a spaced location from the outer casing; and at least one ring, wherein the outer casing is connected with a positive fit at least one of to the foot part and to the head part by way of integrating the at least one ring, wherein the at least one ring is in contact with a fastener receiving structure and an outer surface of the at least one end, the fastener receiving structure being located radially outward of the outer casing, the fastener receiving structure comprising at least one opening, the at least one opening receiving at least a portion of the fastener.

2. The centrifugal pump according to claim 1, wherein the ring comprises multiple parts including two identical ring halves, the fastener receiving structure comprising an inward projection, the at least one end comprising an axially extending end portion, the area adjacent to the at least one end comprising an axially extending outer casing portion, the axially extending end portion being located radially outward of the axially extending outer casing portion, the outer casing comprising an outwardly bent portion connecting the axially extending end portion and the axially extending outer casing portion, the outwardly bent portion and the inward projection being in contact with the ring, the fastener receiving structure being connected to the foot part, the at least one opening being adjacent to at least one foot part opening of the foot part, the at least one foot part opening receiving another portion of the fastener.

3. The centrifugal pump according to claim 1, wherein a means for radial displacement of the ring is provided at least one of on the head part and on the foot part.

4. The centrifugal pump according to claim 1, further comprising a positive-fit means for holding the outer casing at least one of on the foot part and on the head part in a rotationally fixed manner, the positive-fit means being provided at an axial end of the outer casing.

5. The centrifugal pump according to claim 1, wherein the foot part comprises an inner foot part, the inner foot part comprising a first portion and a second portion, at least the first portion and the second portion defining a groove, at least a portion of the at least one end being arranged in the groove.

6. The centrifugal pump according to claim 5, wherein the at least one end is in direct contact with the first portion and the second portion.

* * * * *